United States Patent [19]

Watanabe et al.

[11] Patent Number: 4,509,542

[45] Date of Patent: Apr. 9, 1985

[54] COIN COUNTING AND PACKAGING MACHINE

[75] Inventors: Kenkichi Watanabe; Katusuke Furuya, both of Tokyo, Japan

[73] Assignee: Laurel Bank Machine Co., Ltd., Tokyo, Japan

[21] Appl. No.: 400,676

[22] Filed: Jul. 22, 1982

[30] Foreign Application Priority Data

Jul. 23, 1982 [JP] Japan ..... 56-115522

[51] Int. Cl.[3] ..... G07D 9/04

[52] U.S. Cl. ..... 133/8 A; 133/1 R

[58] Field of Search ..... 133/1 R, 1 A, 8 R, 8 A; 232/15, 16; 141/140, 141, 159, 160, 161; 53/67, 69, 70, 254; 377/7

[56] References Cited

U.S. PATENT DOCUMENTS 1,284,310 11/1918 Gilbert ..... 141/160

2,357,391 9/1944 Francis ..... 133/8 R 3,441,716 4/1969 Lopata ..... 377/7

*Primary Examiner*—F. J. Bartuska

*Attorney, Agent, or Firm*—Fleit, Jacobson, Cohn & Price

[57] ABSTRACT

A coin counting and packaging machine performs a counting operation for counting selected coins and accommodating the coins thus counted into a bag and a packaging operation for packaging selected and counted coins with a paper. These operations are selectively performed separately or individually. When the counting operation is carried out in a state that the bag is prepared, coins are scattered in the machine. To avoid this, a detecter is provided for detecting the presence or absence of the bag and a control circuit is provided for control the start of the machine in response to the signal from the detector. The control circuit also make the switching of a counting chute and a packaging chute.

2 Claims, 5 Drawing Figures

COIN COUNTING AND PACKAGING MACHINE

BACKGROUND OF THE INVENTION

The present invention relates to a coin counting and packaging machine for performing the operations of selecting, counting and packaging coins.

In the coin counting and packaging machines, there are performed the packaging operation of piling a predetermined number of selected and counted coins and packaging them in the rod-like form as well as the counting operation of throwing selected and counted coins scatteringly into a coin bag. But, these operations are selectively carried out separately or individually. The following structure of a prior art is adopted for performing these two operations. As shown in FIG. 1, predetermined coins which are delivered on a selecting course 2 by a delivery belt 1 in the pressed and sliding state. In case of the packaging operation, a packaging chute 4 is arranged on the outlet of the selecting course 2, and the coins 3 are fed through the packaging chute 4 into a packaging mechanism (not shown) and are packaged in the packaging mechanism. In case of the counting operation, a counting chute 5 is arranged on the outlet of the selecting course 2, and the coins 3 are contained scatteringly in a coin bag 6 attached to the top end of the counting chute 5. The packaging chute 4 and counting chute 5 are formed integrally with each other and are reciprocally moved by rotation of a motor 9 connected through cams 7A and 7B and a link 8, so that one of the chutes 4 and 5 is alternatively located at the outlet portion of the sorting course 2.

However, the operation of locating the packaging chute 4 or counting chute 5 at the outlet of the selecting course 2 is appropriately performed based on the judgement of an operator. Accordingly, when the counting chute 5 is located at the outlet of the selecting course 2, it sometimes happens that the machine is erroneously started in the state where a coin bag 6 is not attached to the counting chute 5 and coins are scattered on the floor. Furthermore, when the packaging chute 4 is located at the outlet of the selecting course 2, it sometimes happens that the machine is erroneously started and coins to be contained in a bag are packaged.

SUMMARY OF THE INVENTION

The present invention is to prevent occurrence of the above-mentioned erroneous operations. More specifically, it is a primary object of the present invention to provide a coin counting and packaging machine in which whether or not a coin bag is attached to the outlet of a counting chute of a coin counter is detected based on a signal indicating whether or not a chute mouthpiece attached to the outlet of the counting chute is electrically conducted to a ring gripping a coin bag between the ring and the chute mouthpiece, and a control circuit is operated by this detection signal to allow starting of the operation of the coin counter only under certain conditions, whereby an erroneous operation is prevented.

In accordance with the present invention, there is provided a machine for counting and packaging coins, which comprises a chute mouthpiece composed of an electrically conductive material such as a metal, which is attached to an outlet of a counting chute for discharging coins scatteringly, a ring formed of an electrically conductive material such as a metal, which grips a coin bag capped on the chute mouthpiece between the ring and the chute mouthpiece, and a control circuit actuated by a detection signal which is emitted depending on whether or not the chute mouthpiece and the ring are electrically conductive, to render inoperable the machine, which is going to discharge coins from the counting chute, when no coin bag is attached to the chute mouthpiece.

DESCRIPTION OF THE DRAWINGS

The present invention will now be described in detail by reference to the accompanying drawings in which.

DESCRIPTION OF THE PREFERRED EMBODIMENTS

Figure 1:
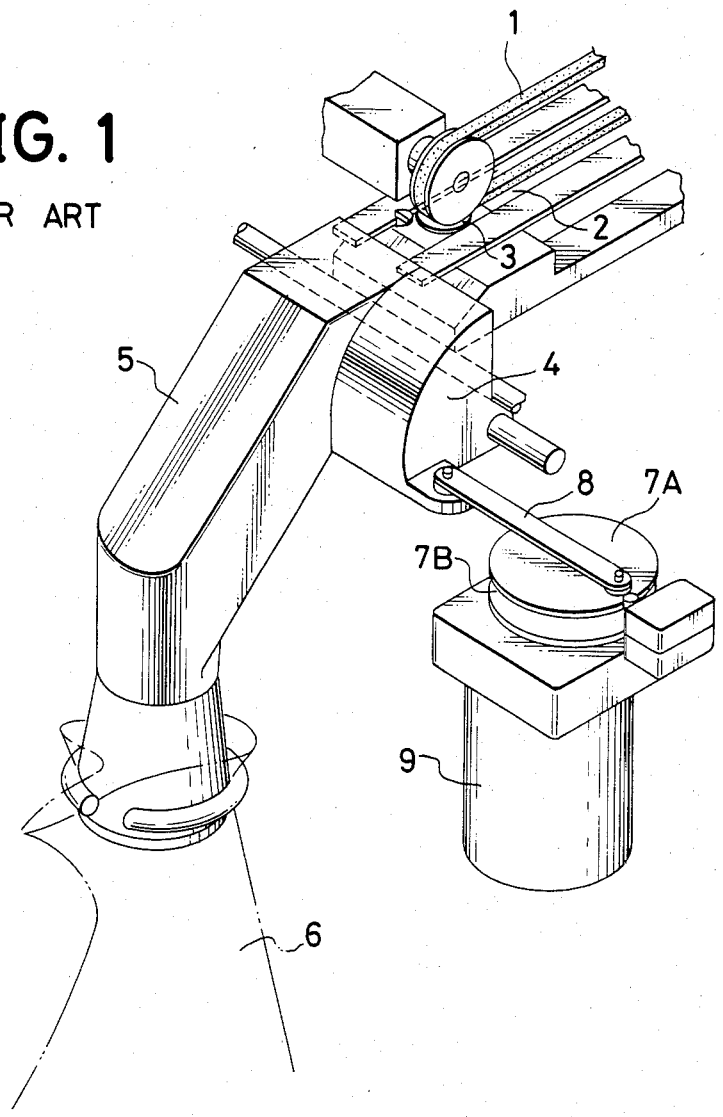
FIG. 1 PRIOR ART
FIG. 1 is a perspective view showing the main portion of counting section of a coin counting and packaging machine of a prior art.

Embodiments of the present invention will be now described in detail with reference to the accompanying drawings.

Incidentally, similar members as those in the conventional machine are indicated by like reference numerals and the detailed explanation related thereto will be omitted.

Figure 2:
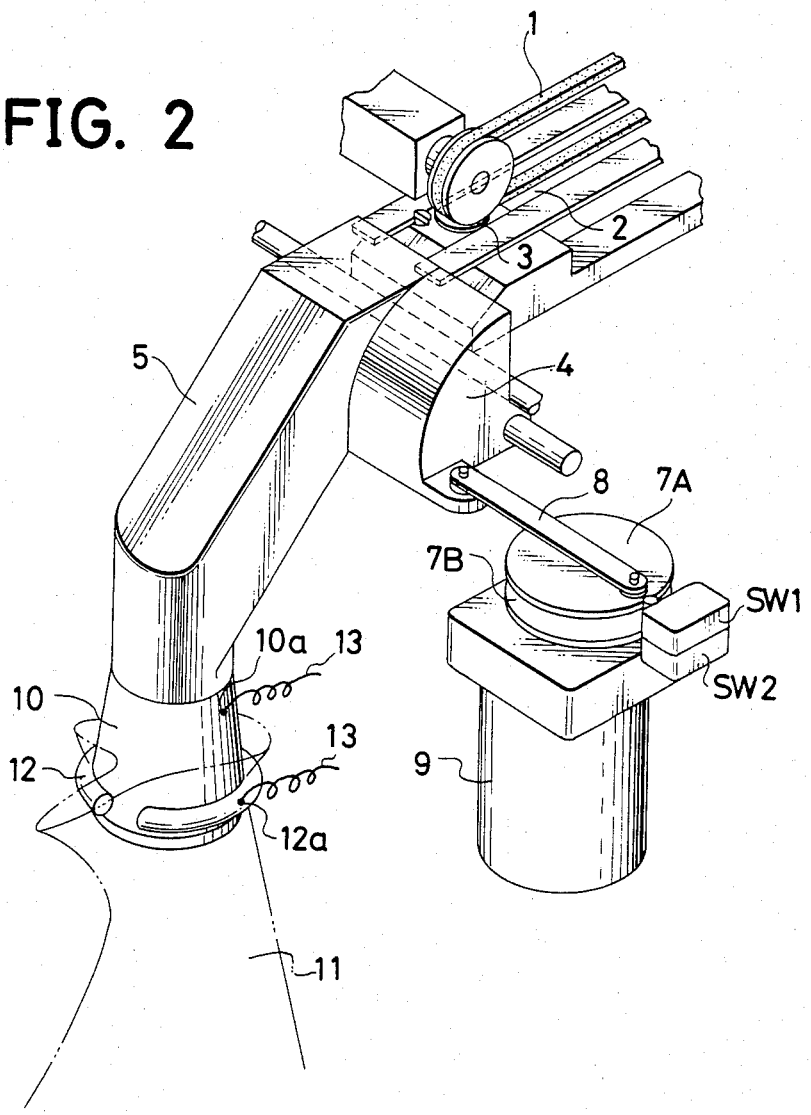
FIG. 2 is a perspective view showing the main portion of counting section of a coin counting and packaging in a first embodiment according to the present invention.
Figure 3:
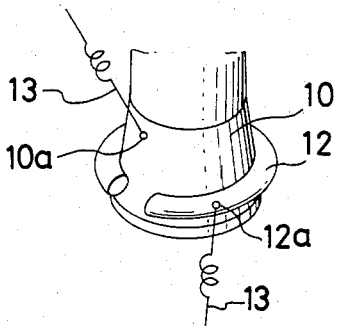
FIG. 3 is a perspective view showing a counting chute for use in the main portion of counting section in detail.

FIGS. 2 and 3 illustrate a first embodiment of the present invention. Reference numeral 10 represents a chute mouthpiece. This chute mouthpiece 10 is formed of an electrically conductive material and attached to the top end of the counting chute 5, and it has a cylindrical shape having an opening directed downward and being expanded toward the opening. A coin bag 11 formed of an electrically insulating material such as a fabric or vinyl resin is capped on the chute mouthpiece 10, and this coin bag 11 is gripped between the chute mouthpiece 10 and a ring 12 fitted on the outer side of the chute mouthpiece 10. This ring 12 is composed of an electrically conductive material such as a metal. Terminals 10*a* and 12*a* formed on the chute mouthpiece 10 and ring 12, respectively, and connected to lead wires 13 are electrically conducted to each other when the chute mouthpiece 10 is kept in direct contact with the ring 12, that is, when the coin bag 11 is not attached to the chute mouthpiece 10. Thus, the presence or absence of the coin bag 11 is detected based on whether or not the terminals 10*a* and 12*a* are electrically conducted to each other.

Switches SW1 ans SW2 are arranged in close proximity to cams 7A and 7B connected to a motor 9 for reciprocally moving the packaging chute 4 and counting chute 5, and these switches SW1 and SW2 are operated by the cams 7A and 7B. These switches SW1 and SW2 are electrically connected so that when the counting chute 5 is arranged on the outlet of the sorting course 2, the switch SW1 is opened and the switch SW2 is closed, and when the packaging chute 4 is arranged on the outlet of the sorting course 2, the switch SW1 is closed and the switch SW2 is opened. According to opening and closing of the switches SW1 and SW2, it is judged which of the packaging chute 4 and counting chute 5 is located at the outlet of the selecting course 2.

Detection of the presence or absence of the coin bag 11 and judgement as to which of the counting chute 5 and packaging chute 4 is located at the outlet of the selecting course 2 are thus performed, and the control circuit described in detail hereinafter are operated by output signals generated as the result of such detection and judgement so that the machine can be operated only under certain conditions.

Figure 4:
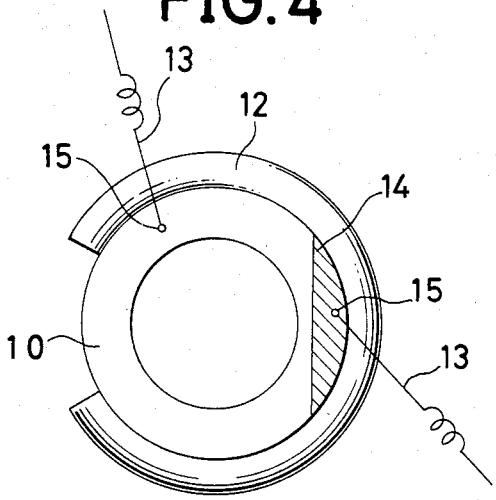
FIG. 4 is an explanatory view showing a counting chute in a second embodiment according to the present invention.

FIG. 4 illustrates a second embodiment of the chute mouthpiece according to the present invention. The chute mouthpiece 10 in at least a portion falling in contact with the ring 12 is divided by an insulator 14 into two parts electrically insulated from each other to form terminals 15, and these terminals 15 are connected to lead wires 13. These terminals 15 are electrically conducted to each other when the ring 12 is kept in direct contact with the chute mouthpiece 10, that is, when the coin bag 11 is not attached to the chute mouthpiece 10. They are electrically insulated from each other when the coin bag 11 is attached to the chute mouthpiece 10. Thus, output signals are generated in the same manner as in the first embodiment. Since each of the lead wires 13 is connected to the chute mouthpiece 10 kept in the stationary state, a trouble such as breakage of the lead wires 13 is not caused to occur on attachment or detechment of the coin bag 11.

Figure 5:
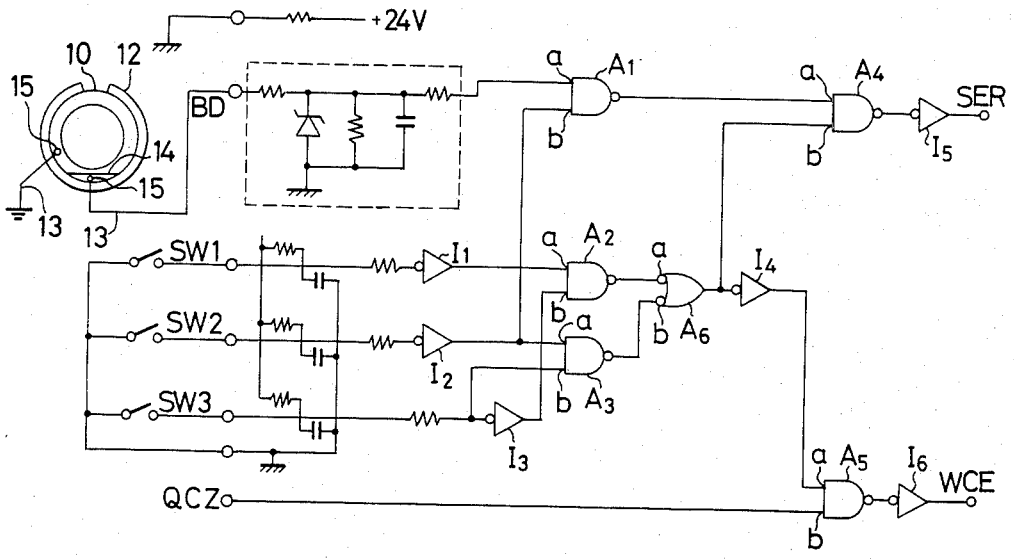
FIG. 5 is a circuit diagram showing an example of the control circuit according to the present invention.

The presence or absence of the coin bag 11 and location of the packaging chute 4 or counting chute 5 are detected in the foregoing manner, and the resulting detection signals are put in the control circuit shown in FIG. 5 to control the machine so that the coin machine is operated only under certain conditions. The operation of the control circuit will now be described with reference to a specific embodiment. In FIG. 5, symbol I represents an inverter and symbol A represents a NAND gate, and suffix numerical indicate the numbers of these inverters and NAND gates, and suffix characters a and b indicate upper and lower input terminals of each NAND gate, respectively. In FIG. 5, a portion surrounded by a dotted line is an interface circuit connecting a detecting device to the control circuit.

The case of a highest occurrence frequency, that is, the case where the coin bag is taken out after completion of the counting operation, and the packaging operation is carried out while the counting chute 5 is arranged on the outlet of the sorting course 2, is now described. In this case, the switch SW1 is opened and the switch SW2 is closed, and the terminals 15 are electrically conducted to each other through the ring 12.

If an operator closes a setting switch SW3 and selects the packaging operation, a low signal (hereinafter referred to as "L") is put out from the switch SW3, a high signal (hereinafter referred to as "H") is put out from the switch SW1 and a signal L is put out from the switch SW2. These signals are put in inverters I1, I2 and I3, respectively. The outputs of these inverter I1, I2 and I3 and an output H of the interface circuit generated by conduction of the terminals 15 are put in input terminals A1*a* through A3*a* and A1*b* through A3*b* of the NAND gates A1 through A3. Input signals for A1*a*, A1*b*, A2*b* and A3*a* are high (H) and input signals for A2*a* and A3*b* are low (L). According to these inputs, and L output is put out from the NAND gate A1 and put into a terminal A4*a* of a NAND gate A4, and H outputs are put out from the NAND gates A2 and A3 and put into the NAND gate A6. One L output of the NAND gate A6 is put in the terminal A4*b* and a H output from the HAND gate A4 is inverted by an inverter I5 and a setting completion signal SER of a low level (L) is obtained. This signal SER indicates whether or not the counting chute 5 or packaging chute 4 is located at the normal position with respect to the operation of the setting switch SW3. In this case, since the couning chute 5 is located at the outlet of the selecting course 2 in the state where the coin bag 11 is not attached, an L output indicating that the setting is not completed is put out.

In a meanwhile, an L output of the NAND gate A6 is inverted by the inverter I4 and the H signal thus obtained is put in the terminal A5*a* of a NAND gate A5, and when a clear signal QCZ of a high level (H) is put in terminal A5*b* of the NAND gate A5 by the starting operation performed by the operator, the L signal is put out from the NAND gate A5 and inverted by the inverter I6 to put out a chute-exchanging signal WCE of a high level (H).

More specifically, it is indicated by the SER signal of a low level (L) that setting is not completed, whereby the machine-starting operation is cancelled, and simultaneously, the signal WCE of a high level (H) is emitted to start the motor 9 and locate the packaging chute 4 at the outlet of the selecting course 4. Thus, the cams 7A and 7B are operated to close the switch SW1 and open the switch SW2. L and H signals and are put out from the switches SW1 and SW2, respectively, L signal is still put out from the switch SW3. In this state, H signals are put in the terminals A1*a*, A2*a*, A2*b*, A4*a* and A6*b* and L signals are put in the terminals A1*b*, A3*a*, A3*b* and A6*a* in the respective NAND gates. Furthermore, the H output of the NAND gate A6 is put in the terminal A4*b* and the L signal is put out from the NAND gate A4. This L output of the NAND gate A4 is inverted by the inverter I5, and an H output of the signal SER indicating completion of setting is obtained. The H output of the NAND gate A6 is inverted by the inverter I4 and is put as an L signal into the terminal A5*a*. Accordingly, inspite of the clear signal QCZ, an H signal is put out from the NAND gate A5, and this signal is inverted by the inverter I6 and a chute-exchanging signal of a low level (L) is obtained. Since the level of the signal WCE is low (L) at this point, the motor 9 is stopped in the state where the packaging chute 4 is located at the outlet of the selecting course 2, and the level of the signal SER is turned to an H state to indicate completion of setting. Then the machine is ready for its start. When the machine is started in this state, coins are fed into a packaging mechanism (not shown) located below through the packaging chute 4 and are packaged without being scattered on the floor or the like. In the case where the coin bag 11 is attached to the counting chute 5 in this state, an L signal is put out from the interface circuit, but because of characteristics of the NAND gate A1, whether the input of A1*a* may be of a level L or H, so far as the input of the terminal A1*b* is at an L level, the output thereof is at an H level and the control circuit is not influenced at all.

The case where it is intended to perform the counting operation without attaching the coin bag 11 to the machine in which the packaging chute 4 has been kept at the position of the outlet of the selecting gate 2 after completion of the packaging operation is now described. In this case, since the packaging chute 4 is located at the outlet of the selecting course 2, the switch SW1 is closed and the switch SW2 is opened, and since the coin bag 11 is not attached to the chute mouthpiece 10 of the counting chute 5, the terminals 15 are conducted to each other.

When the operator instructs the counting operation by opening the setting switch SW3, H, L and H signals are put out from the switches SW3, SW1 and SW2, respectively, and they are inverted by the inverteres I1, I2 and I3, and by these inverted signals and an H signal of the interface circuit generated by conduction of the terminals 15 are put in the NAND gates A1 through A3. H signals are put in the terminals A1*a*, A2*a* and A3*b* and L signals are put in the terminals A1*b*, A2*b* and A3*a*. Then, H signals are put out from the NAND gate A1, A2 and A3, whereby an L signal is put out from the NAND gate A6. By this L signal and the H output of the NAND gate A1, an H signal is put out from the NAND gate A4, and this H output is inverted by the inverter I5. Thus, the level of the setting completion signal SER is turned to the L state to indicate incompletion of setting and cancel the machine-starting operation.

The L output of A6 and NAND gate is inverted and an H signal is put in the terminal A5*a*, and when the clear signal QCZ of an H level is put in the terminal A5*b*, an L signal is put out from the NAND gate A5 and is inverted by the inverter I6 to put out a chute-exchanging signal WCE of an H level.

More specifically, the signal SER of an L level indicate incompletion of setting and cancels starting of the machine, and simultaneously, the motor 9 is started by the signal WCE of an H level to locate the counting chute 5 at the outlet of the selecting course 2 and then, the switch SW1 is opened and the switch SW2 is closed. H and L signals are put out from the switches SW1 and SW2, respectively, and an H signal is still put out from the switch SW3. These signals are inverted by the inverters I1, I2 and I3, and the inverted outputs and an H signal of the interface circuit generated by conduction of the terminals 15 are put in the NAND gates A1 through A3. At this point, H signals are put in the terminals A1*a*, A1*b*, A3*a* and A3*b* and L signals are put in the terminals A2*a* and A2*b*. Then L, H and L signals are put out from the NAND gate A1, A2 and A3, respectively. Accordingly, an H signal is put out from the NAND gate A6, and an H signal is continuously put out from A4 the NAND gate by this H signal of A6 the NAND gate and the L signal of the NAND gate A1. This H signal is inverted by the inverter I5 to produce a resetting completion signal SER of an L level indicating incompletion of resetting. The H signal of the NAND gate A6 is inverted by the inverter I4 and the L signal thus inverted is put in the terminal A5*a*, and an H signal is put out from the NAND gate A5 and is inverted by the inverter I6 to put out a chute-exchanging signal WCE of an L level. Accordingly, the motor 9 is not operated and the counting chute 5 is kept set.

In this state, since the setting completion signal SER is at a low level it is impossible to start the machine. Accordingly, the machine is prevented from being started before attachment of the coin bag 11. When the operator attaches the coin bag 11 to the chute mouthpiece 10, since the ring 12 is not allowed to have direct contact with the chute mouthpiece 10, no electric conduction is produced between the terminals 15. Accordingly, the level of the output of the interface circuit is turned to an L state, and the L signal is put in the terminal A1*a* and the level of the NAND gate A1 is turned to an H state. Accordingly, the H signal is put in each of the terminals A4*a* and A4*b*, and an L signal is put out from the NAND gate A4. This L signal is inverted by the inverter I5, and the level of the setting completion signal SER is turned to an H state to render starting of the machine possible.

The foregoing operations will now be summarized. In the case where it is intended to perform the packaging operation in the state where the counting chute 5 is located at the outlet of the selecting course 2 and the coin bag 11 is not attached to the counting chute 5, starting of the machine is rendered impossible. If the motor 9 is then turned to locate the packaging chute 4 at the outlet of the selecting course, whereby starting of machine is rendered possible. In the case where it is intended to perform the counting operation in the state where the packaging chute 4 is located at the outlet of the selecting course 2, starting of the machine is rendered impossible, and when the motor 9 is then turned to locate the counting chute 5 at the outlet of the selecting course 2, if the coin bag 11 is not attached to the chute mouthpiece 10, starting of the machine is kept impossible until the coin bag 11 is attached.

In the foregoing embodiments, as means for detecting whether or not the coin bag is attached to the mouthpiece of the counting chute, there is adopted a method in which conduction in a plurality of terminals mounted on either or both of the chute mouthpiece and the ring is detected. Furthermore, there may effectively be adopted a method in which a piezoelectric element or the like is bonded to the chute mouthpiece and the difference of the electromotive force of the piezoelectric element between the case where the coin bag is attached and the case where the coin bag is not attached is detected. In this case, it becomes possible to use a material which is poor in the insulating property for the coin bag. Furthermore, there may be adopted a method in which a power source for starting the coin counting and packaging machine is operated by the setting completion signal SER so that the machine is automatically started after completion of setting.

Referring to FIG. 5, each of the ground connected to a power source voltage of +24 V through a resistor and the ground connected to the chute mouthpiece 10 through the lead line 13 indicates a flame ground and the other ground indicates a signal ground, and both the grounds are insulated from each other.

Accordingly, when the coin bag is not attached, +24 V of the frame ground is supplied to the input terminal BD of the interface circuit, and the output terminal of the interface circuit is maintained at +5 V (H), which is substantially equal to the power source voltage of the control circuit. When the coin bag is attached, +24 V is not applied to the input terminal BD of the interface circuit but the input terminal BD is maintained at the same voltage as that of the signal ground, that is, 0 V (L).

As will be apparent from the foregoing description, according to the present invention, each of the chute mouthpiece attached to the outlet of the counting chute for discharging coins scatteringly and the ring fitted in the outer portion of the chute mouthpiece to grip a coin bag between the ring and mouthpiece is formed of an electrically conductive material such as a metal, and the control circuit of the machine is operated by a detection signal generated by detection of the presence or absence of the coin bag based on whether or not the mouthpiece and the ring are electrically conducted to each other. By dint of the above structural feature, according to the present invention, occurrence of an accident such as scattering of coins on the floor by discharge of coins from the counting chute by an erroneous operation in the state where a coin bag is not attached to the mouthpiece of the counting chute is effectively prevented.

What is claimed is:

1. A machine for counting and packaging coins, which comprises:

a chute mouthpiece of an electrically conductive material attached to an outlet of a counting chute for discharging coins therethrough;

a ring of an electrically conductive material seated on the chute mouthpiece;

a coin bag of an electrically insulating material adopted to be capped on the chute mouthpiece between the ring and the chute mouthpiece;

means for generating a first signal when the coin bag is capped on the chute mouthpiece between the ring and the chute mouthpiece due to the electrical isolation of said ring from said chute mouthpiece, and for generating a second signal when the coin bag is not capped on the chute mouthpiece due to the electrical connection between said ring and said chute mouthpiece, the generating means being electrically coupled to said chute mouthpiece and said ring; and a control circuit for rendering the machine operable to cause the coins to be discharged into the coin bag, in response to the first signal of the generating means and for rendering the machine inoperable to prevent the coins from being discharged, in response to the second signal of the generating means.

2. A machine for counting and packaging coins according to claim 1, wherein the chute mouthpiece is formed to have a cylindrical shape and is circumferentially divided in a plurality of segments electrically insulated from one another.

* * * * *